US007156728B1

(12) United States Patent
Killough

(10) Patent No.: US 7,156,728 B1
(45) Date of Patent: Jan. 2, 2007

(54) ADJUSTABLE SUPPORT FOR A SANDER

(76) Inventor: Floyd Duane Killough, 1330 N. Howe St., Apt. 3, Southport, NC (US) 28461

( * ) Notice: Subject to any disclaimer, the term of this patent is extended or adjusted under 35 U.S.C. 154(b) by 0 days.

(21) Appl. No.: 11/440,748

(22) Filed: May 25, 2006

(51) Int. Cl.
*B24B 41/00* (2006.01)

(52) U.S. Cl. ..... 451/361; 451/354; 451/360

(58) Field of Classification Search ..... 451/354, 451/353, 360, 361, 350–352, 355–359
See application file for complete search history.

(56) References Cited

U.S. PATENT DOCUMENTS

| | | | | |
|---|---|---|---|---|
| 1,919,854 | A | 7/1933 | Masseau | |
| 2,049,935 | A | 8/1936 | Woodward | |
| 2,238,757 | A | 4/1941 | Stevason | |
| 2,670,577 | A | 3/1954 | McDonough | |
| 2,755,606 | A | 7/1956 | Ronvold et al. | |
| 3,268,935 | A * | 8/1966 | Ungeheuer | 15/21.1 |
| 3,665,542 | A * | 5/1972 | Franzreb | 15/98 |
| 3,948,005 | A | 4/1976 | Whitsett | |
| 4,381,911 | A | 5/1983 | Bell | |
| 4,923,251 | A | 5/1990 | Funakawa et al. | |
| 5,099,539 | A * | 3/1992 | Forester | 15/144.3 |
| 5,138,800 | A | 8/1992 | Janusz | |

* cited by examiner

*Primary Examiner*—Dung Van Nguyen
(74) *Attorney, Agent, or Firm*—Michael E. Mauney

(57) ABSTRACT

An adjustable moveable support for an existing drywall sander. A plurality of legs are centrally mounted and extend from a collar to rotating caster wheels which rest on a floor. The caster wheels allow for movement of the moveable support. Extending through the collar is a vertical boom with a mounting sleeve at one end of the vertical boom. An existing pole-like drywall sander may be mounted in the mounting sleeve. The height of the vertical boom may be adjusted to place the existing drywall sander in proximity to a drywall surface to be sanded. Control handles mounted on the legs allow an operator to engage the sander on the drywall sander on the drywall surface to be sanded. The caster wheels allow the device to be readily moved to appropriately sand seams or other surfaces in the drywall. A control handle may be mounted on either side of the adjustable support so that it may be used with equal ease by left-handed or right-handed users. The legs fold so the removable support may be folded for easy transportation or storage.

16 Claims, 5 Drawing Sheets

100
100
700
910
280
260
260
250
270
500
290

ADJUSTABLE SUPPORT FOR A SANDER

FIELD OF THE INVENTION

This invention relates generally to an adjustable support to be used with a preexisting sanding tool. Its specific application is for sanding a building material called drywall.

BACKGROUND OF THE INVENTION

Many different types of materials are used in building. These include wood, concrete, stone, metal and drywall. It is frequently necessary to finish these materials by a grinding, sanding, or polishing process. For this reason there are many different tools specifically designed to accomplish the necessary finishing of a surface. Sometimes the smoothing is simply to make the surface more pleasant to the touch or appearance. On other occasions, it is designed to make the surface more receptive to coatings like paint. When the surface to be finished is a floor, it is relatively simple to do. A variety of floor grinders or polishers is available. A person simply stands with hands on the controls and moves the grinding machine back and forth over the surface to be finished. Ordinarily, the machine has an electric motor which drives a rotating pad on which a abrasive surface is placed. Care is required to make sure the grinding force is evenly applied across the surface—otherwise gouges, swirl marks, and the like can mar the surface for which a smooth and uniform finish is desirable. This process is more problematic when the surfaces which must be treated are a wall or ceiling.

Because of the difficulty in reaching ceiling surfaces, a number of expedients have been proposed. Whitsett, U.S. Pat. No. 3,948,005 discloses a ceiling grinding apparatus for use in grinding concrete ceilings. There is a portable support assembly with wheels, at least two of which are mounted on pivoting casters. There is a boom supported on a vertical arm. At one end of the boom is the grinding apparatus. The other end of the boom may be controlled directly by an operator or may be controlled by a control handle connected to the control end of the boom by springs, ropes or the like. A similar apparatus is seen in Ronvold, et al, U.S. Pat. No. 2,755,606 and McDonough, U.S. Pat. No. 2,670,577. Another variation of a ceiling sander or grinding apparatus for concrete or stone is seen in Woodward U.S. Pat. No. 2,049,935. What each of these machines has in common is a recognition that the kind of grinding apparatus required for a surface as hard as concrete or stone may be too heavy or unwieldy for comfortable use by an individual without the use of a support apparatus.

However, for most home construction, concrete ceiling or stone ceilings are unusual, if not unknown. More commonly, a building material known as drywall, which is a gypsum based material with a paper surface is used for the interior cover for the wood framing which constitutes the framework of a house. Drywall material is much softer and easier to work with than concrete, stone, or even wood. It readily receives paint with no necessity for preliminary sanding or treatment. However, the drywall comes in standard sizes. It must be cut and fitted together to form the walls or ceilings. It will ordinarily nailed into place and the nails be covered with a compound material called spackling which dries into a smooth surface. The spackling compound placed over the nails holes may require light sanding in order to match the spackling compound with the surrounding surface of the drywall. Where two pieces of drywall are joined ordinarily a piece of tape is applied over the joint with a spackling compound usually called "mud" used to cover the tape and to make the surface ready for application of paint. However, where the drywall seams or joints have been taped and muddied must be sanded in order to smooth the surface to match it to the surrounding drywall. Sanding tools are specifically designed and sold for this purpose.

A drywall sander is somewhat stereotypically designed with at one end a pivoting, rotating head on which a piece of sand paper or other grinding material is attached. An electric motor drives the pivoting, rotating head in rotational motion like a circular sander. A flexible hose connects this rotating head with a small vacuum container or canister which operates simultaneously with the rotation of the circular sanding head. This means that as the sanding is taking place, there is an automatic suction, vacuuming away the dust generated by the sanding. This simplifies cleanup and means that further dusting or vacuuming is unnecessary before paint is applied to the resulting sanded surface. The drywall sander itself is several feet long with the rotating head at one end of a handle with operating controls usually placed somewhere approximately between the two ends near the balance point on the arm of the sanding device. For up to eight foot ceilings, this device is sufficient to sand the seams in the walls and ceilings and can be used, albeit with some difficulty, to sand the ceilings and walls slightly higher than eight feet. However, many residential homes are being built with ten or twelve foot ceilings or with cathedral ceilings as high as fifteen feet. This requires the operator of the sanding device to stand on scaffolding or some other elevated surface. This is a cumbersome, time consuming, and sometimes dangerous process for the operator of the sander. Consequently, there is an unmet need for a device to be used with an existing drywall sander for sanding drywall or materials like drywall which require a light touch, where there is a limited surface to be sanded like seams or joints between sheets of building material, and where the surface to be sanded is higher than shoulder height.

SUMMARY OF THE INVENTION

In order to effectively operate as a support platform for an existing drywall sander this invention is readily assembled and disassembled so it can be moved from one job to another. It is designed to hold an existing drywall sander in place for sanding dry wall beginning at approximately shoulder height and extending to approximately fifteen feet in height. It is designed for easy and rapid maneuverability. It allows for quick and ready height adjustment for the support for the drywall sander. It is designed that the sanding head on an existing drywall sander may be used to apply a flat, level pressure for sanding so as not to gouge or damage the delicate drywall. It is designed with opposing springs so that without pressure applied by an operator the sander will not contact the surface to be sanded. This allows the operator precise control over both the angle and pressure applied through the sander to the surface to be sanded.

DETAILED DESCRIPTION OF THE DRAWINGS

Figure 1:
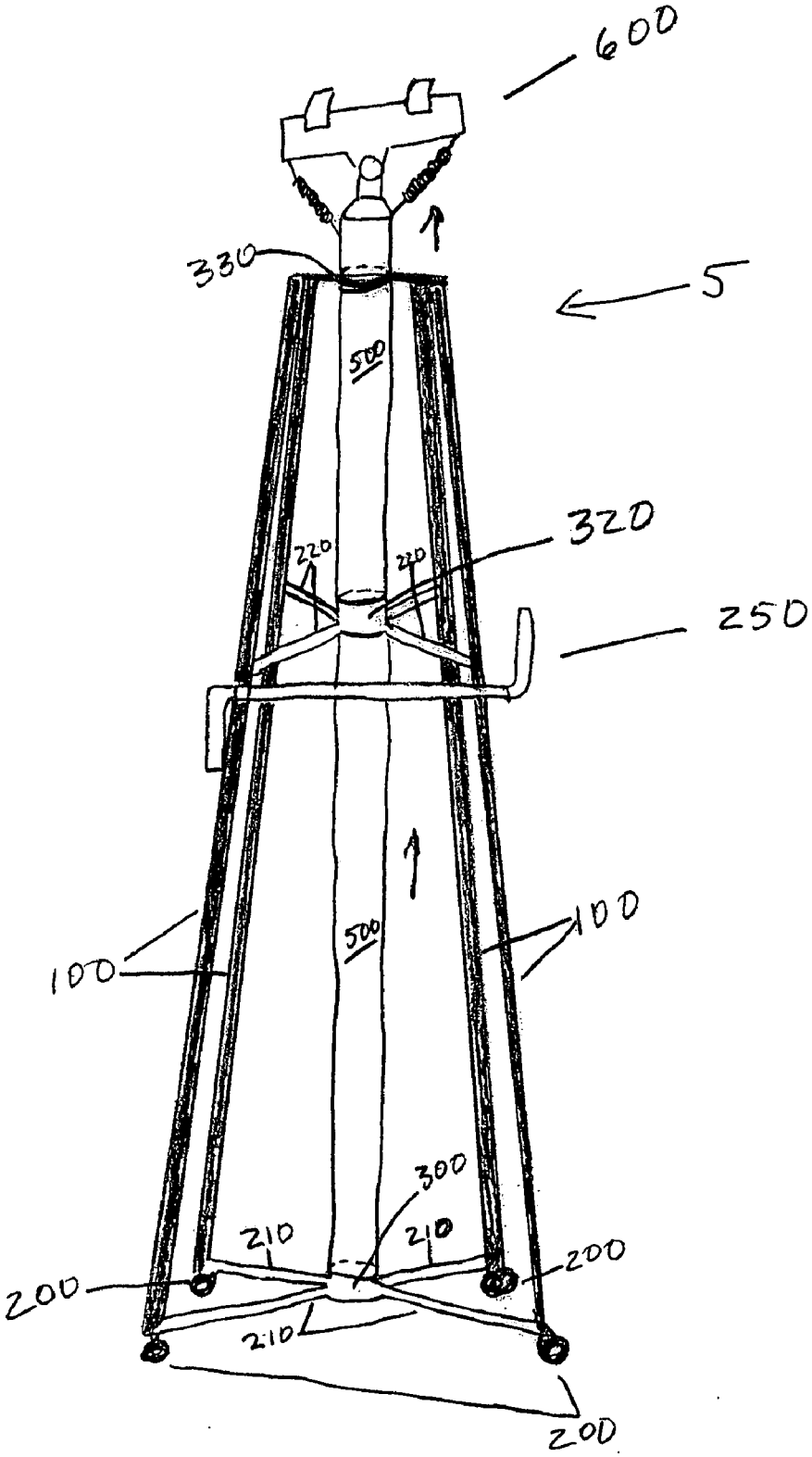
FIG. 1 shows the adjustable support.

FIG. 1 shows the adjustable support for a sander (5). There are four support legs (100) mounted in a spaced relationship with each other, each approximately 90 degrees removed from the other. They are angled inward from caster wheels (200) ends of the support legs (100). At one end of each of the support legs (100) is mounted a caster wheel (200) for 360 degree rotatable movements. This facilitates ease of movement of the sander support (5). Mounted at the radius of the support legs (100) is an adjustable boom (500). Lower radial arms (210) extend from the lower collar (300) to a point just above the mounting of the caster wheels (200) on the support legs (100). The lower collar (300) is sized for receipt therein the vertical boom (500). The radial arms (210) pivot allowing the lower collar (300) to move vertically on the support boom (500) making it possible to vary the circumference defined by the four caster wheels (200). As the radial arms (210) pivot upwardly on the support boom (500), the four support legs (100) move closer to the vertical boom (500), also reducing the distance between the support legs (100). An upper movable collar (320) is attached to radial arms (220) at a point approximately one-third of the length of the support legs (100). When the vertical boom (500) is fully retracted, its bottom end is in the lower collar (300). Also, the vertical boom (500) passes through the fixed collar (330) and the upper moveable collar (320). The support boom (500) may be raised from its position in the lower collar (300) to extend it upwardly in the direction shown by the arrow. When a satisfactory vertical extension has been achieved for the vertical boom (500), it may be fixed into place and held securely in place therein by the upper collar (320) and the fixed collar (330).

Figure 2:
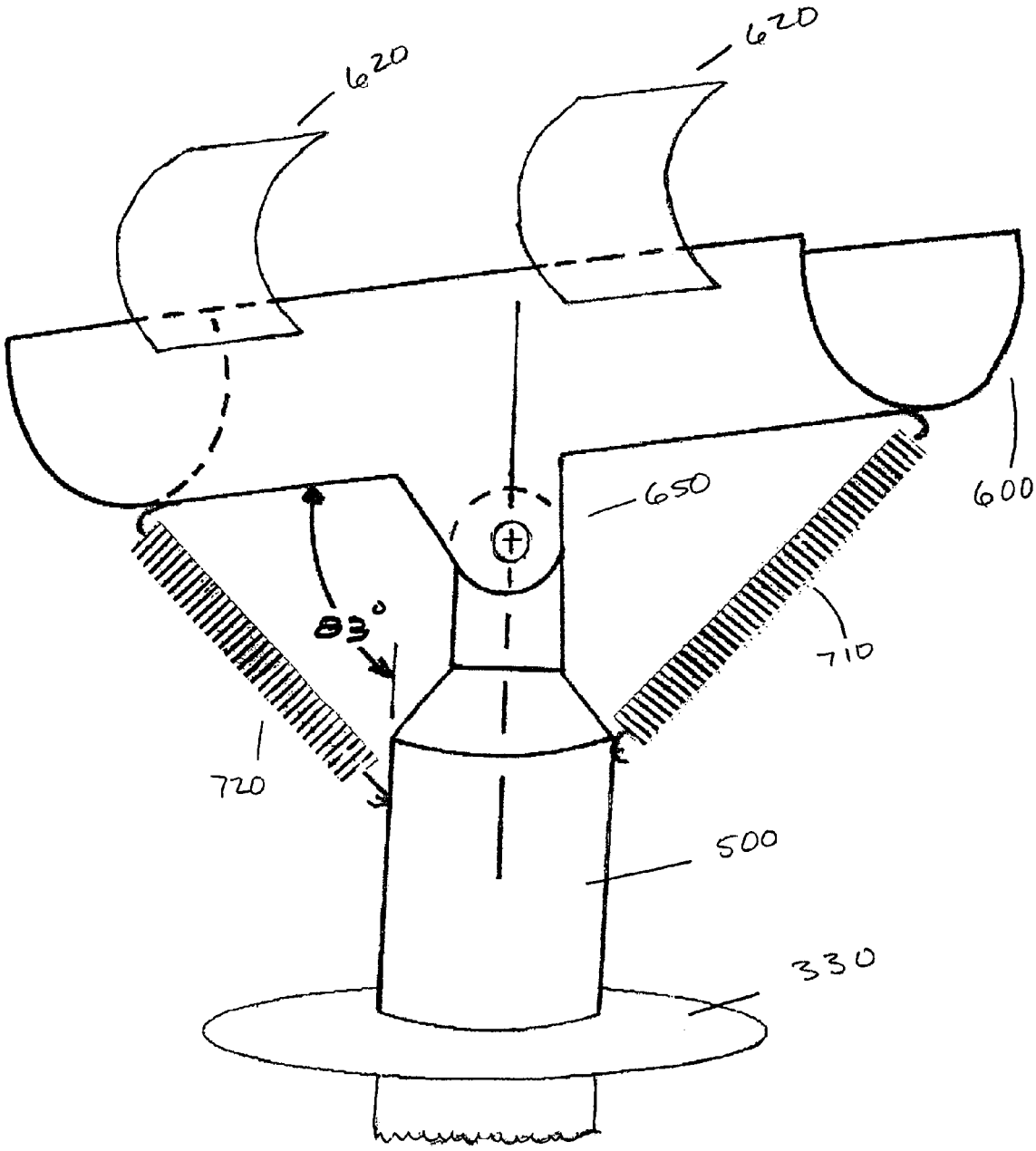
FIG. 2 shows the sander mounting sleeve.

FIG. 2 shows in more detail the sander tool mounting sleeve (600) which is at the end of the vertical boom (500). Drywall sanders are typically built with a handle shaped much like a pole. At one end of the handle is the circular sanding surface powered by a motor. The pole-like handle is used by the operator to hold and control the sanding and vacuum action. The mounting sleeve (600) is an open U-shaped container with a diameter slightly larger than the typical of the handle of a sander. A sander is placed in the mounting sleeve (600) and mounting clips (620) are folded over the handle of the sander and fixed into place on opposite sides of the mounting sleeve (600). Thus the sander is securely attached in the mounting sleeve at the end of the vertical boom (500). The mounting sleeve (600) is mounted on a pivot (650) which allows for rotational movement of the mounting sleeve (600) in a limited arc in a vertical plane. At each end of the mounting sleeve (600) are two stabilizing springs (710 and 720). The stabilizing springs (710 and 720) are ordinarily of the same length and same strength. They attach at opposite ends of the sander tool mounting sleeve (600). Each stabilizing spring (710 and 720) also attach to the vertical boom (500). However, the spring (710) mounts at a higher point on the boom (500) than does the spring (720). Because the springs are the same length and of the same strength, this results in a bias when the stabilizing spring (720) mounting point on the sleeve (600) is at a point closer to the surface or floor on which the adjustable support stands. This means that the sleeve (600) is not parallel to the floor or at a 90 degree angle to the vertical boom (500). Rather the lower end where the stabilizing spring (720) is mounted is at an angle of 83 degrees, as is shown in FIG. 2. The lower end of the mounting sleeve (600) will ordinarily receive the sanding end of the sander tool, while the opposite higher end where the stabilizing spring (710) is mounted will receive the end opposite the sanding end of the sanding tool. Consequently, should the vertical boom (500) be extended to the point to where one end of the sander tool was in contact with a horizontal ceiling surface, it would be the opposite end of the tool that was in contact with the sanding surface and not the sander end. This means there must be some active control by the operator in order to bring the sander into play. The drywall is easy to damage with a rotating sander head on the sander. Consequently, it is important that the rotating head of the sander only comes in contact with the drywall under the control of the operator. It has been found in practice that an angle of 83° assures that the rotating head of the sander will not come into contact with the ceiling unless the operator uses the control handles (250) to engage the sander with the drywall. Ordinarily, the sander will be mounted in the mounting sleeve (600) at or near its balance point. However, the stabilizing springs (710 and 720) assure a constant angle whether the sander is mounted in the mounting sleeve (600) at its balance point or at some other point. This assures a consistency of control in the control handles (250) for an operator.

Figure 3:
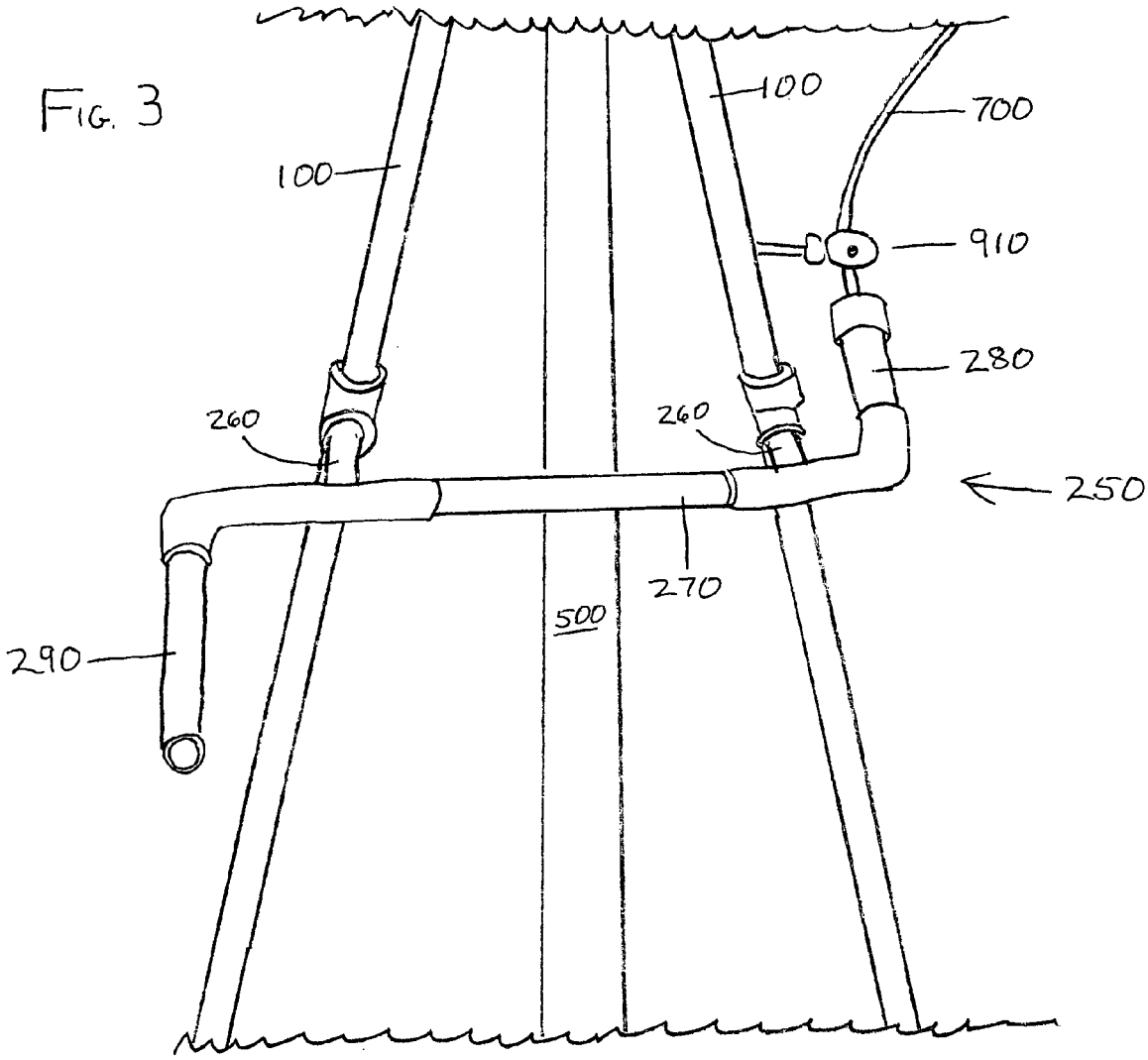
FIGS. 3 and 3A shows the control handle on the adjustable support.
Figure 3A:
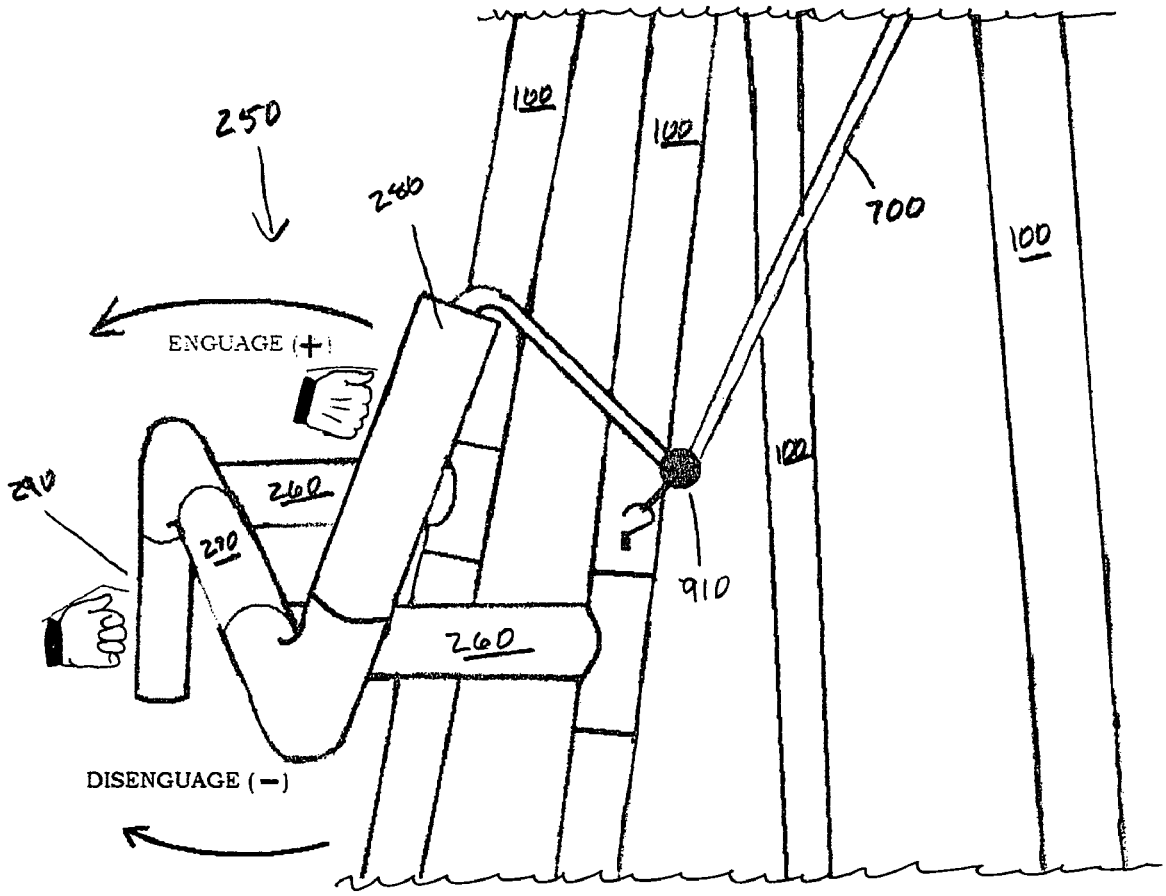

FIG. 3 shows the control handle (250) used for control of the drywall sander. The control handle (250) is mounted on two adjacent support legs (100). The control handle (250) consists of a horizontal bar (270) which is rotatably mounted on support legs (100) by the control handle legs (260). At each end of the horizontal bar (270) are the control hand grip (280) and hand grip (290) mounted in opposable directions from each other—that is to say, the control hand grip (280) points in the opposite direction from the hand grip (290). This control hand grip (280) has connected at one end of the control hand grip (280) opposite from the mounting on the horizontal bar (270), a control hand cord (700) which goes through a control cord pulley (910) mounted on the leg (100). The user would grip the hand grip (290) and control hand grip (280) pulling the control hand grip (280) toward the user and pushing the hand grip (290) away from the user rotating the horizontal bar (270) in a counter clockwise direction. The motion of the control hand grip (280) pulls the control cord (700) through the control cord pulley (910). Because the control hand grip (280) and the hand grip (290) are pushed in opposite directions, this tends to alleviate any tendency of pulling the adjustable support of the sander (5) either toward the user or pushing the adjustable support for a sander (5) away from the user as these handles are manipulated. The effect of pulling on the control hand grip (280) while pushing on the hand grip (290) tends to result in a purely rotational movement of the horizontal bar (270) without causing any horizontal force on the adjustable support for the sander (5). The control cord (700) is connected to one end of the drywall sander so that as the control cord (700) is pulled, it pulls that end of the drywall sander toward the floor, raising the sanding end of the drywall sander for contact with the surface to be sanded. FIG. 3A shows in more detail the operation of the control handle (250). Here, the control handle (250) is seen in perspective view. The control hand grip (280) will be pulled in the counter clockwise direction, as indicated by the arrow and by the small drawing of a hand in proximity to the control hand grip (280). The hand grip (290) will be pushed, also in the counter clockwise direction, rotating the horizontal bar (270) in a counter clockwise direction. The effect of this is to pull the control cord (700) toward the body of the user, which, in effect, shortens the amount of cord between the control cord pulley (910) and the point of termination of the control cord (700) on the unseen drywall sander. This pulls the end of the drywall sander to which the control cord (700)

is mounted toward the control cord pulley (910). In lowering the control cord end of the drywall sander, it forces a clockwise rotation of the sleeve (600), shortening the control spring (710) and lengthening the control spring (720). This raises the opposite end of the drywall sander from the end where the control cord (700) is mounted. This causes the drywall sander to engage the sanding surface of the drywall sander against the drywall. This is shown in more detail in FIG. 4. To disengage the drywall sander, the process is reversed where the hand grip (290) is pulled in a clockwise direction, as shown by the clockwise arrow labeled "disengaged" and the control hand grip (280) is pushed in a clockwise direction. As shown in FIG. 3A, the right hand of a user would be engaging the control hand grip (280) and the left hand the hand grip (290). However, the apparatus is designed with dual mounting positions on the opposite support legs (100). This requires a remounting of the horizontal bar (270), but is easily accomplished and allows both left and right handed dominant individuals to use the hand they most prefer to control the operation of the drywall sander mounted in the adjustable support for a sander (5).

Figure 4:
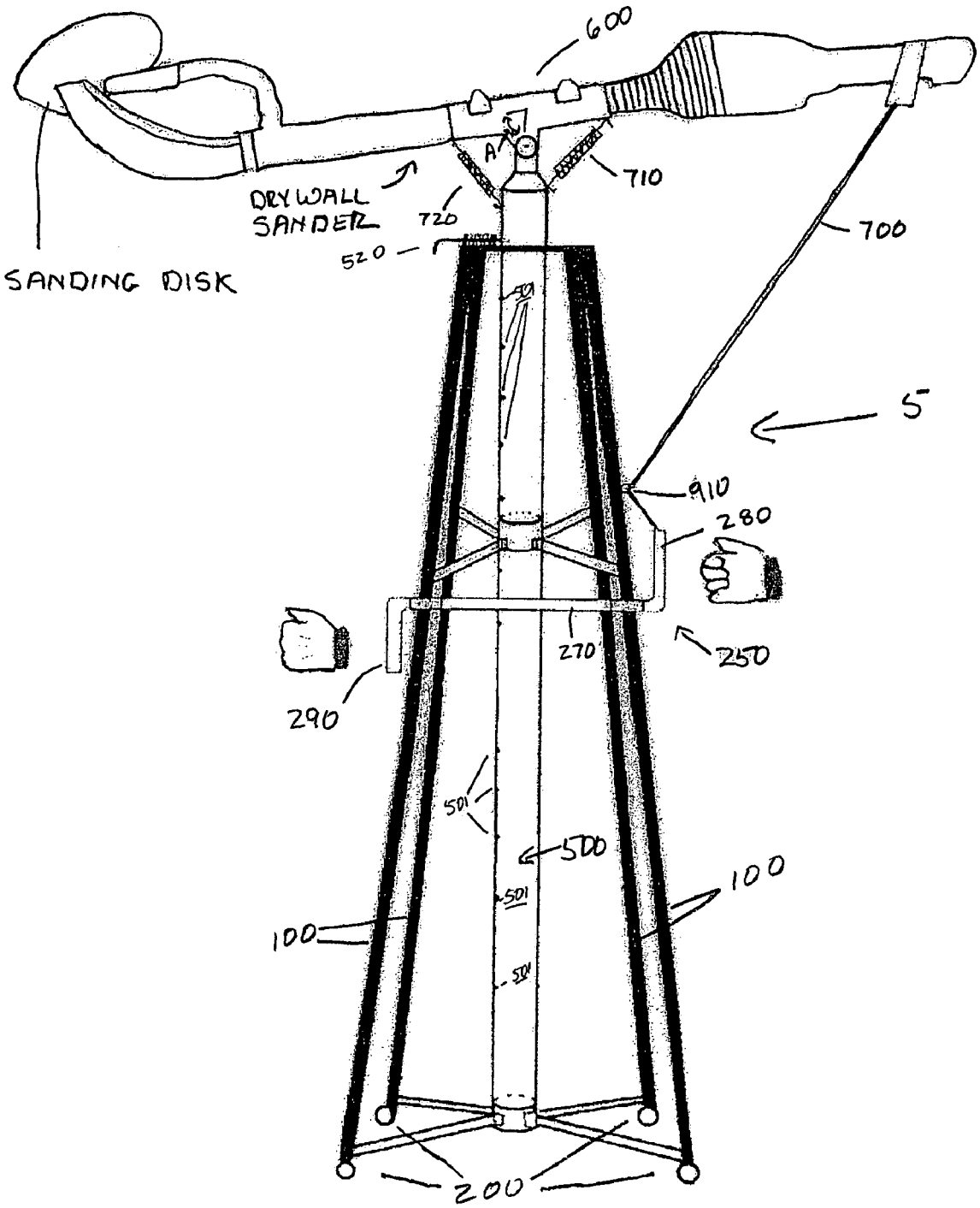
FIG. 4 shows a drywall sander mounted in the adjustable support.

FIG. 4 shows the adjustable support for a sander (5) with an existing drywall sander mounted thereon. The four support legs (100) are shown with a boom (500) in place and ready for use. A mounting sleeve (600) is used to mount a drywall sander. The sanding disk end of the drywall sander is mounted on the spring (720) side of the mounting sleeve (600), so that the sanding disk is disengaged from contact with a drywall surface. The control cord (700) is attached to the drywall sander at the end opposite from the sanding disk, passes through the control cord pulley (910), and attaches to the control handle (280). When the control hand grip (280) is pulled toward a user, as is shown by the hand in proximity to the control hand grip (280), it pulls the control cord (700) through the control cord pulley (910), shortening the length of the control cord (700) between the control cord pulley (910) and its point of attachment to the drywall sander. This pulls that end of the drywall sander down, forcing the sanding disk end upward, changing the angle (A) from the default angle of 83° and bringing the sanding disk in proximity to the surface to be sanded. Should the operator relax the pressure or release the control handle (280), the stabilizing springs (710 and 720) bring the drywall sander back to the default angle shown as angle (A), equal to 83°. Caster wheels (200) allow for ready movement of the adjustable support for sander (5). The vertical boom (500) is adjusted using the adjusting holes (501) and the spring mounted adjusting pin (520). The adjusting pin (520) is pulled from an appropriate adjusting hole (501). The boom (500) moved in a vertical direction to align an appropriate adjustment hole (501) with the adjusting pin (520). Then when the appropriate vertical orientation is achieved for the vertical boom (500) the adjusting pin (520) is placed in the appropriate mounting hole (501) and is held into place there by the spring of the spring mounted adjusting pin (520). When is use, the center of the mounting sleeve (600) should be approximately 12 to 13 inches from the surface to be sanded. This assures that the sanding disc is not in contact with the surface to be sanded when the mounting sleeve (600) is in the default position and the angle A is 83 degrees. As the control handle (280) is used to move the sanding disc to the surface to be sanded, the distance of 12 to 13 inches between the mounting sleeve (600) and the surface to be sanded assures that the sanding disc will approach the surface to sanded in the appropriate relatively flat orientation. It is not necessary that one have a continuous adjustment of the vertical boom (500) as long as it is mounted with an inch or two of the correct position. If so, the sanding disc will approach the surface to be sanded in the appropriate orientation and will be easily operated.

It will be readily appreciated how the adjustable support for sander (5) works. An existing drywall sander is mounted using the mounting sleeves (600). The boom is adjusted to an appropriate vertical height. The control cord (700) is connected to the appropriate end of the drywall sander so that the control hand grip (280) may be used. The sanding disk on the drywall sander is turned on and an operator stands in proximity to the control handle (250) and uses the control hand grip (280) to engage the drywall sander to sand the surface to be sanded. The mounting sleeve (600) along with the springs (710 and 720) assure easy and delicate control of the sanding end of the sander. The caster wheels (200) allow for ready movement along a drywall seam or joint to be sanded. In using the adjustable support for a sander (5) to sand 10-foot ceilings, the adjustable boom (500) needs to be adjusted only once. Once the drywall sander is mounted in place and the control cord (700) connected, the entire sanding job can be completed without any further adjustments. The adjustable support for a sander (5) readily folds for easy transportation, is easy to set up and take down, simplifies the job of sanding a ceiling as high as 15 feet, while allowing an operator to remain safely on ground without using scaffolds, ladders, or the like. The above description is meant for explanation only. The only limitations appear in the claims which follow.

I claim:

1. An adjustable movable support for an existing drywall sander comprising:

(a) a plurality of legs connected at at least one collar;

(b) in said at least one collar connecting said plurality of legs an opening for receiving a vertically adjustable boom;

(c) a vertically adjustable boom;

(d) At a first end of said vertically adjustable boom, a mounting sleeve on a pivoting mount for adjustment in a vertical plane defined by said vertically adjustable boom with at least two stabilizing springs connected to said mounting sleeve and to said vertical boom whereby said mounting sleeve is held at a particular angle to said vertically adjustable boom by said stabilizing springs;

(e) means for said plurality of legs to move on a horizontal surface.

2. An adjustable movable support for an existing drywall sander of claim 1 further comprising a control handle, said control handle mounted to at least two of said plurality of legs, said control handle mounted on said at least two legs for rotatable movement, and at a first end of said control handle a control cord connectable to existing drywall sander mounted in said mounting sleeve whereby when said control handle is rotated, said control cord moves said existing drywall sander to engage a sanding surface of said drywall sander with drywall to be sanded.

3. An adjustable movable support for an existing drywall sander of claim 2 wherein said plurality of legs consists of four legs, said four legs mounted in a spaced relationship with each other.

4. An adjustable movable support for an existing drywall sander of claim 3 wherein said means for said four legs to move comprises a caster wheel at a first end of each of said four legs.

5. An adjustable movable support for an existing drywall sander of claim 4 wherein said caster wheels are pivotally mounted at said first ends.

6. An adjustable movable support for an existing drywall sander of claim 5 wherein said four legs are connected at a second collar, said second collar having an opening for receipt of said vertically adjustable boom and said second collar slidably moveable on said boom whereby said four legs may fold inwardly for transportation or storage.

7. An adjustable movable support for an existing drywall sander of claim 6 wherein said vertically adjustable boom further comprises means for releasably mounting said vertically adjustable boom in said first collar whereby said mounting sleeve is at a particular distance to a horizontal surface whereon said caster wheels are resting.

8. An adjustable movable support for an existing drywall sander of claim 7 wherein said mounting sleeve held at a particular angle is held at a particular angle less than 90° to said vertically adjustable boom but more than 75° to said vertically adjustable boom.

9. An adjustable movable support for an existing drywall sander of claim 8 wherein said control handle may be mounted at a first and second legs of said four legs whereby said control handle is readily manipulated by a person with their right hand and said control handle is readily mounted to third and fourth legs of said four legs whereby said control handle is readily manipulated by a person with their left hand.

10. An adjustable movable support for an existing drywall sander comprising:

(a) four legs, each of said legs attached to a first fixed collar and in a spaced relationship with each other;

(b) means for said four legs to move on a horizontal surface;

(c) a second movable collar connecting said four legs, said fixed collar and said moveable collar having an opening therein holding a vertically adjustable boom;

(d) a vertically adjustable boom;

(e) at a first end of said vertically adjustable boom a mounting sleeve for mounting an existing drywall sander, said mounting sleeve rotatable in a vertical plane;

(f) a first stabilizing spring connected to a first end of said mounting sleeve and a second stabilizing spring connected to a second end of said mounting sleeve, each of said first and second stabilizing springs connected to said first end of said vertical boom, said stabilizing springs holding said mounting sleeve at a particular angle relative to said vertically adjustable boom.

11. An adjustable movable support for an existing drywall sander of claim 10 further comprising a control handle mounted to a first and second of said four legs or said control handle mounted to a third and fourth of said four legs, said control handle mounted for rotatable movement and control of a control cord connectable to an existing drywall sander whereby when said control handle is rotated said control cord moves said existing drywall sander to engage a sanding surface of said drywall sander with drywall to be sanded.

12. An adjustable movable support for an existing drywall sander of claim 11 wherein said vertically adjustable boom further comprises means for releasably mounting said vertically adjustable boom in said first fixed collar whereby said mounting sleeve is at a particular distance to a horizontal surface.

13. An adjustable movable support for an existing drywall sander of claim 12 wherein said mounting sleeve held at a particular angle is held at a particular angle less than 90° to said vertically adjustable boom but more than 75° to said vertically adjustable boom.

14. An adjustable movable support for an existing drywall sander of claim 13 wherein said second moveable collar slides on said vertically adjustable boom thereby folding said four legs so said adjustable moveable support may be readily stored or transported.

15. An adjustable movable support for an existing drywall sander of claim 14 wherein said means for moving comprises a caster wheel at a first end of each of said four legs.

16. An adjustable movable support for an existing drywall sander of claim 15 wherein said caster wheels are pivoting caster wheels.

* * * * *